US008647058B2

(12) United States Patent
Thut

(10) Patent No.: US 8,647,058 B2
(45) Date of Patent: Feb. 11, 2014

(54) CEMENTLESS PUMP FOR PUMPING MOLTEN METAL

(76) Inventor: Bruno H. Thut, Chagrin Falls, OH (US)

( * ) Notice: Subject to any disclaimer, the term of this patent is extended or adjusted under 35 U.S.C. 154(b) by 401 days.

(21) Appl. No.: 13/169,083

(22) Filed: Jun. 27, 2011

(65) Prior Publication Data

US 2012/0328428 A1 Dec. 27, 2012

(51) Int. Cl.
*F04D 7/00* (2006.01)

(52) U.S. Cl.
USPC ..... 415/200; 415/213.1

(58) Field of Classification Search
USPC ..... 415/200, 213.1, 214.1; 29/888.02, 29/888.021
See application file for complete search history.

(56) References Cited

U.S. PATENT DOCUMENTS

| | | | | |
|---|---|---|---|---|
| 2,110,379 | A * | 3/1938 | Lannert | 92/182 |
| 5,330,328 | A * | 7/1994 | Cooper | 417/424.1 |
| 5,435,374 | A * | 7/1995 | Fishkis et al. | 164/97 |
| 5,558,505 | A * | 9/1996 | Mordue et al. | 417/360 |
| 6,082,965 | A * | 7/2000 | Morando | 415/200 |
| 6,457,940 | B1 * | 10/2002 | Lehman | 415/206 |
| 6,869,271 | B2 * | 3/2005 | Gilbert et al. | 416/204 R |
| 6,869,564 | B2 * | 3/2005 | Gilbert et al. | 266/239 |
| 6,887,425 | B2 * | 5/2005 | Mordue et al. | 266/235 |
| 7,497,988 | B2 | 3/2009 | Thut | |
| 7,507,365 | B2 | 3/2009 | Thut | |
| 7,687,017 | B2 | 3/2010 | Thut | |
| 2013/0213630 | A1 * | 8/2013 | Southard, II | 165/185 |

OTHER PUBLICATIONS

The application as filed in U.S. Appl. No. 12/787,556, filed May 28, 2010.

* cited by examiner

*Primary Examiner* — Edward Look
*Assistant Examiner* — Liam McDowell
(74) *Attorney, Agent, or Firm* — Pearne & Gordon LLP

(57) ABSTRACT

In a cementless pump for pumping molten metal, support structure is suspended above the molten metal. A motor is supported by the support structure. A shaft is fastened to the motor. An impeller is mounted to a lower end of the shaft. A refractory base is supported in the molten metal and includes at least one impeller chamber in which the impeller is rotated and at least one discharge passageway. The base includes through holes. Support posts are each fastened to the support structure and to the base. Refractory sleeves are each disposed in one of the through holes. Post fastening members fasten the lower ends of the posts to the base without cement. A portion of each of the post fastening members is located inside the refractory sleeve. Also featured is a method of replacing posts in a cementless pump for pumping molten metal.

28 Claims, 6 Drawing Sheets

CEMENTLESS PUMP FOR PUMPING MOLTEN METAL

TECHNICAL FIELD

The technical field is pumps for pumping molten metal and, in particular, the posts used in such pumps to connect a base in which the impeller rotates to a motor support structure.

BACKGROUND

Due to the oxidizing effects of molten metal, components of pumps in the molten metal inevitably wear out. Such components that wear out include the shaft for driving the rotor and the pump posts that support the base in the molten metal. When assembling a pump, a fixture may be used for aligning the posts relative to the base especially when cement is used. Cement is used to secure the posts to the base or to cap a bolt on the bottom of the base to prevent intrusion of molten metal. Once the pump is lifted from the molten metal to replace the posts, the usage of cement becomes problematic. The cement needs to be removed with a chisel since it is harder than the surrounding graphite of the base and resists machining After chiseling to remove the cement, the shapes of the holes that receive the posts become distorted. Thus, preparing the base to receive new posts becomes a labor intensive, drawn out process. Chiseling out the cement and possibly drilling new holes to receive replacement posts, aligning the posts and curing the cement holding the posts or caps in place can take two days. Thus, an improved pump and method for replacing posts without the need for cement would be advantageous.

TECHNICAL SUMMARY

This disclosure features a cementless pump for pumping molten metal. Support structure (e.g., a motor mount plate) is suspended above a bath of molten metal. A motor is supported by the support structure. A shaft is fastened at an upper end thereof to the motor and has a lower end. An impeller is mounted to a lower end of the shaft. A refractory base is supported in the bath of molten metal. The base includes at least one impeller chamber in which the impeller is rotated and at least one discharge passageway leading from the impeller chamber. The base includes through holes. Support posts are each fastened at an upper end thereof to the support structure and at a lower end thereof to the base. Refractory sleeves are each disposed in one of the through holes. Each of the support posts is connected to the base without cement by post fastening members, wherein a portion of each of the fastening members is located inside the refractory sleeve. For example, the fastening member can be a nut outside the base and a threaded bolt portion of the post extending through the through hole of the base, which is threaded to the nut. Alternatively, the fastening members can be formed wherein each post includes an internally threaded opening at the lower end. Another portion of the fastening member can be a bolt that includes a head, a shank extending from the head and an exteriorly threaded portion at an end of the shank. The shank is disposed inside the refractory sleeve and the threaded portion of the bolt is threaded to the internally threaded opening of the post so that the head engages the base. The posts are fastened to the base without use of any cement.

Turning now to specific features of the cementless pump, a refractory (e.g., fiber) gasket can be disposed between a lower surface of each of the posts and the base and between each of the post fastening members and the base (e.g., between the base and the nut or the head of the bolt). The posts, bolts and nuts can be made of refractory material such as ceramic or graphite. The base can be made of suitable refractory material such as graphite. The refractory sleeves are softer than graphite. For example the refractory sleeves are made of ceramic, such as an aluminum boron oxide. A density of the refractory sleeves can be not greater than 0.60 g/cm$^3$, more particularly, not greater than 0.50 g/cm$^3$, and specifically about 0.48 g/cm$^3$.

Each of the refractory sleeves is configured and arranged to have an outer diameter and length that are the same as a diameter of the through holes and a length of the through holes, respectively.

In a method of replacing the posts of a molten metal pump, after the pump has been operated for awhile and the posts, shaft and/or rotor have become worn, it is desired to replace the posts, among other components of the pump. When the pump has been operated for an extended period of time, wherein the base and posts have been submerged in the molten metal bath, molten metal may enter the through holes of the base. This can be resisted by the use of gaskets between the posts and an upper surface of the base and between the post fastening member and the lower surface of the base but may not be altogether prevented. As a result, once the pump has been removed from the molten metal and cooled, the metal can form a crust inside the through holes. When cement is used to fasten or cap the bolts or posts to the base, as in conventional pumps such as the Tensor Post™ pump by Pyrotek Inc., it forms a very hard material on the base that requires chiseling to remove, which damages the shape of the through holes in the base. The cement is harder than the graphite material of the base, which causes deflection of the chisel or a drill when attempting to remove the cement. In contrast, when using the relatively soft refractory sleeves of this disclosure in the through holes, the refractory sleeves are easily removed without significant damage to the shape of the through holes. All that might remain is a thin crust of metal on the surface of the holes after the refractory sleeves have been removed, which can easily be scraped out.

In summary, the method of replacing the posts of a molten metal pump includes the following steps. After the pump has been operated and it is desired to replace the posts, the posts are cut near the upper surface of the base (e.g., through the bolts or through the elongated portion of the posts). For example, the cutting may occur through the threads of the bolt and any remaining piece of the post may be chiseled off the top of the bolt. The remainder of the bolt is removed from the through hole, such as by tapping a rigid rod into the through hole having a diameter somewhat less than the diameter of the through hole. The remaining refractory sleeve and any remaining metal adhered to the surface of the base that forms the hole can then be removed such as by scraping (e.g., without any need of machining) Then, replacement posts can be installed in the pump, along with the post fastening members, to form the cementless pump as described above.

The cementless pump of this disclosure is advantageous because it avoids the time and expense of applying cement to connect the posts to the base. To the inventors knowledge there are no pumps today for pumping molten metal that do not use cement to fasten or cap the posts, or bolts used with them, to the base. More importantly, once the posts need replacement in the cementless pump of this disclosure, the through holes that were formed in the base can be reused, because there is no problematic hardened cement that deflects drills and chisels and damages the through holes when removing the posts from the base. This will enable posts to be replaced efficiently and easily. Instead of at least two days of post rebuilding during which the cement is removed with difficulty, the base has new holes drilled in it to accommodate the damage of chiseling, and the cement is cured, the cementless pump and method of this disclosure will enable the posts to be replaced in a few to several hours without the need for chiseling, machining or curing of cement. When using the Tensor Post™ system of Pyrotek, an assembly fixture is needed to properly align the posts because there is play between the post and post holes for cement clearance. In contrast, an assembly fixture for aligning the posts during post replacement will not be needed in the cementless pump of this disclosure. The posts of this disclosure will be self positioning because of the snug fit of the post fastening member against the refractory sleeve and the machined through hole surface of the base.

Another advantage is that the cementless pump and method of this disclosure will minimize the investment in spare parts. Typically, to accommodate the expected need to replace the posts during every 2 weeks to three months, molten metal processors keep 2 replacement pumps on hand. Therefore, while a pump is being repaired a replacement pump is being used and a spare replacement pump remains. The device and method of this disclosure can eliminate one of the replacement pumps due to the substantially faster time to repair the posts of the pump and reduced pump down time in the event of failure of the replacement pumps. Occasionally, a major problem occurs during molten metal processing in which both replacement pumps are damaged or defective while a pump is having its posts replaced over a two day duration. This will require adding heat to maintain the temperature of the molten metal in the furnace while the pumps are being repaired. In contrast, if such a major problem occurs during the repair of the cementless pump of this disclosure, there is only at most several hours of down time. Thus, the cementless pump of this disclosure could result in savings of energy costs during such a major multiple pump failure problem.

The cementless pumps of this disclosure may include two, three or more stacked impeller chambers and associated impellers or impeller portions and discharge passageways, for various functions of transfer and circulation, as disclosed in U.S. Pat. Nos. 7,687,017 and 7,507,365, which are incorporated herein by reference in their entireties, and/or may be used for various functions of scrap submergence, circulation and transfer using a vortexer apparatus as disclosed in U.S. Pat. No. 7,497,988, which is incorporated herein by reference in its entirety. The cementless pump of this disclosure may also be used with the vortexer system disclosed in U.S. patent application Ser. No. 12/787,556, which is incorporated herein by reference in its entirety. Also, the cementless pump may include only a single impeller, a single impeller chamber and a single discharge passageway.

Many additional features, advantages and a fuller understanding of the invention will be had from the accompanying drawings and the detailed description that follows. It should be understood that the above Technical Summary describes the invention in broad terms while the following Detailed Description describes the invention more narrowly and presents preferred embodiments that should not be construed as necessary limitations of the broad invention as defined in the claims.

DETAILED DESCRIPTION

Figure 1:
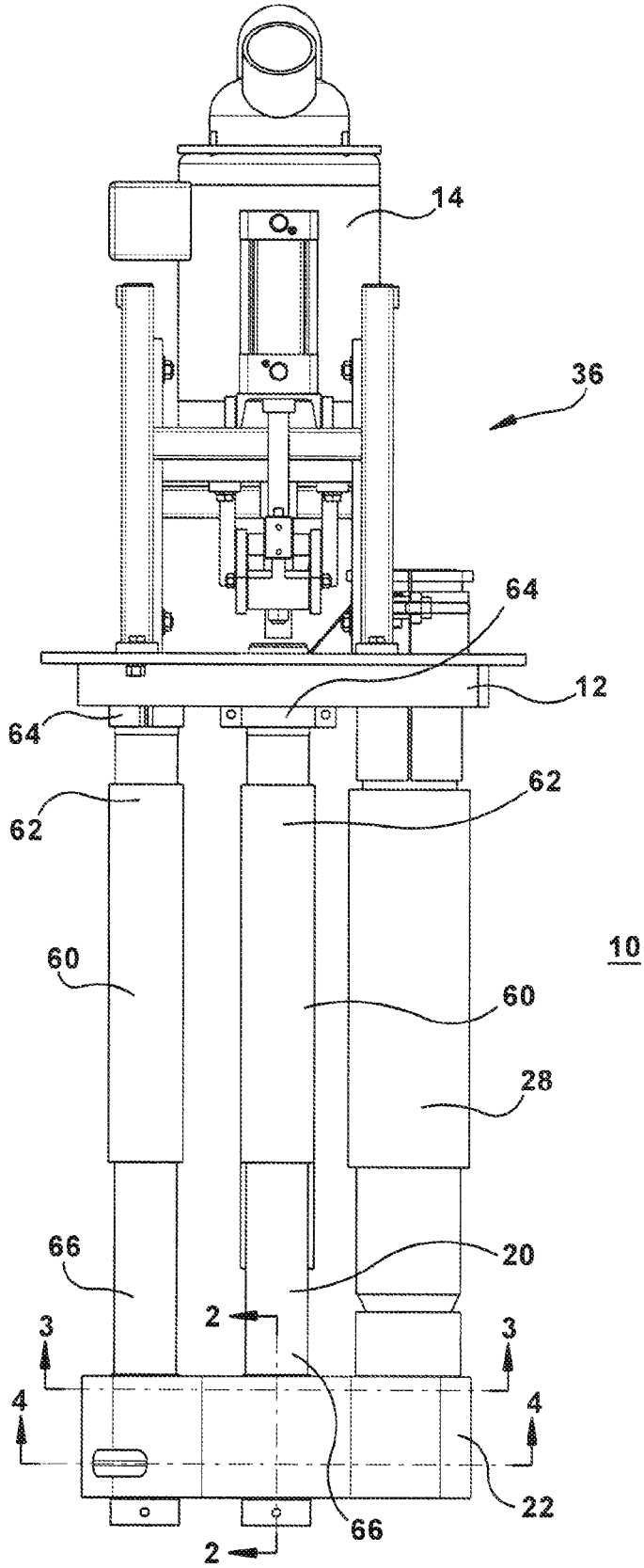
FIG. 1 is a side view of a cementless pump made according to the present disclosure.

This disclosure features a cementless pump 10 for pumping molten metal. A motor mount plate 12 is suspended above a bath of the molten metal. A motor 14 is supported by the motor mount plate. A pump shaft 16 is fastened at an upper end 17 thereof to a drive shaft 18 of the motor. An impeller 19 is mounted to a lower end 20 of the pump shaft. A refractory base 22 is supported in the bath of molten metal. In the particular example shown, the base includes one upper transfer impeller chamber 24 and associated transfer discharge passageway 26 leading to a riser 28 for transfer to another location and one lower circulation chamber 30 and associated circulation discharge passageway 32 leading to an exterior opening 34 of the base. An impeller positioning device 36, including various types of actuators and optional programmable logic controller, can be used for moving the impeller into alignment with the transfer discharge passageway only, the circulation discharge passageway only, or both the transfer discharge passageway and the circulation discharge passageway, as disclosed in the U.S. Pat. Nos. 7,687,017 and 7,507,365 . The base 22 includes an upper inlet opening 38 leading to upper inlet openings 40 of the impeller 19 and a lower inlet opening 42 leading to lower inlet openings 44 of the impeller. The impeller 19 includes vanes 46 and cavities 48 between the vanes on a side of the impeller forming outlet openings 50 of the impeller that communicate with the upper and lower impeller inlet openings and are aligned with one or both of the discharge passageways 26, 32. The impeller and base include suitable bearing rings 52. Exterior threads 54 on the pump shaft 16 are screwed to a central threaded opening 56 of the impeller. The base 22 includes through holes 58. Support posts 60 are each fastened at an upper end thereof 62 to the motor mount plate 12 such as using one or more clamps 64 and at a lower end thereof 66 to the base to suspend the base in the molten metal. Refractory sleeves 68 are each disposed in one of the through holes. Each of the support posts 60 is connected to the base 22 without cement by post fastening members 70, wherein a portion 72 of each of the post fastening members is located inside the refractory sleeve.

In one aspect, the post fastening members 70 can be formed by each post including an internally threaded opening 74 at the lower end 66. Another portion of the post fastening member 70 can be a bolt 76 that includes a head 78, a shank 80 extending from the head and an exteriorly threaded portion 82 at an end of the shank. The shank is disposed inside the refractory sleeve and the threaded portion 82 of the bolt is threaded to the internally threaded opening 74 of the post so that the head 78 engages the base 22. The through hole 58 would typically extend between upper surface 84 and lower surface 86 of the base 22. The bolt head 78 would ordinarily be located near (e.g., in contact with) the lower surface 86 of the base. The posts 60 are fastened to the base without use of any cement. The posts 60 and bolts 76 are ideally made of a refractory material. The refractory sleeves 68 have an outer diameter and length that approximate the diameter and length of the through holes 58 in the base. For example, each of the refractory sleeves 68 can have an outer diameter of 2-4 inches and a thickness of 3/16-¼ inch. The outer diameter of the shank 80 of the bolt 76 can approximate the inner diameter of the refractory sleeve so as to minimize the intrusion of molten metal inside the through holes 58. The heads 78 can be countersunk into the base.

Figure 2A:
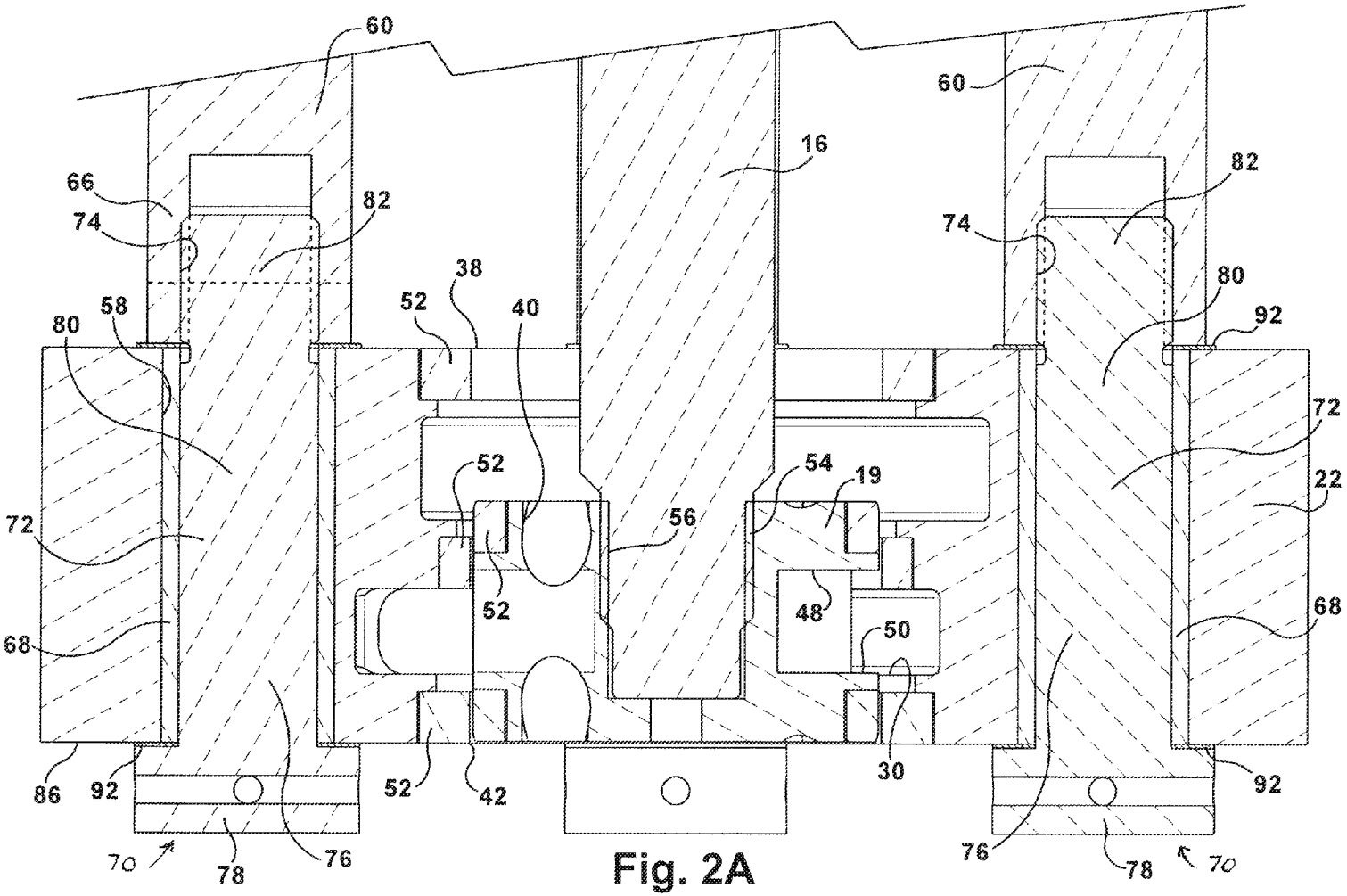
FIG. 2A is an enlarged, cross-sectional view as seen along the cutting plane designated 2-2 in FIG. 1 showing one aspect of post fastening members.
Figure 2B:
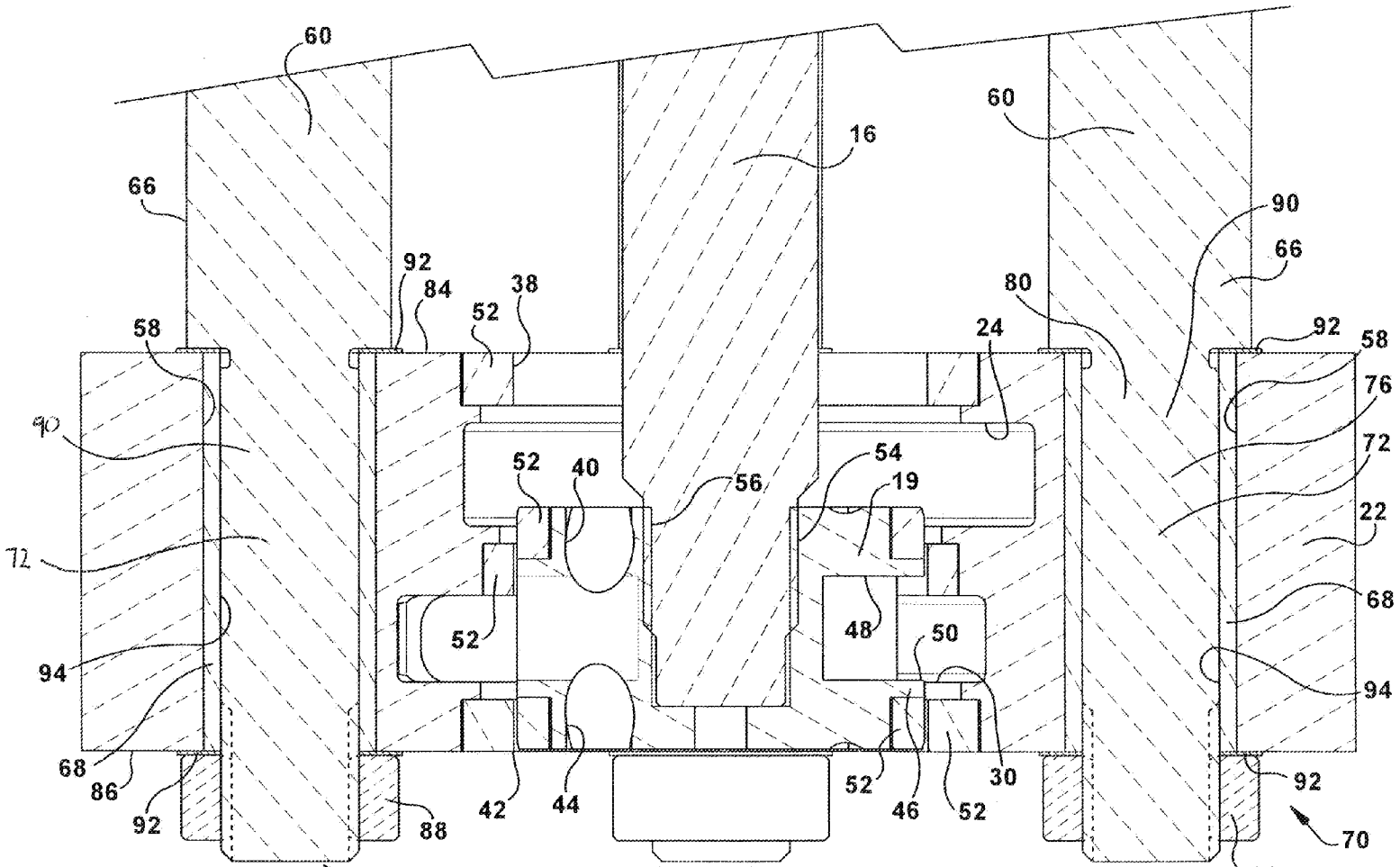
FIG. 2B is an enlarged, cross-sectional view as seen along the cutting plane designated 2-2 in FIG. 1 showing another aspect of post fastening members.
Figure 3:
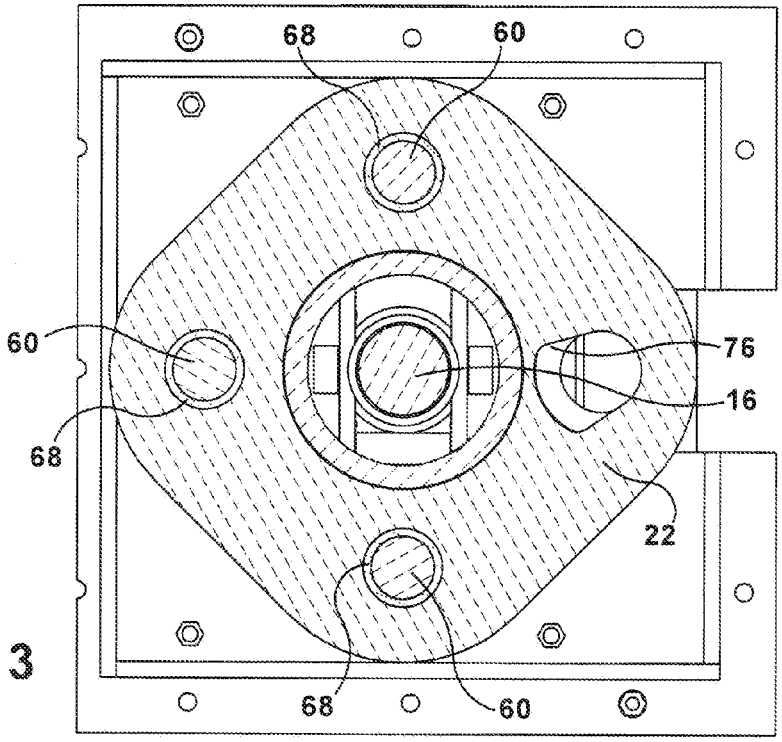
FIG. 3 is a cross-sectional view as seen along the cutting plane designated 3-3 in FIG. 1.
Figure 4:
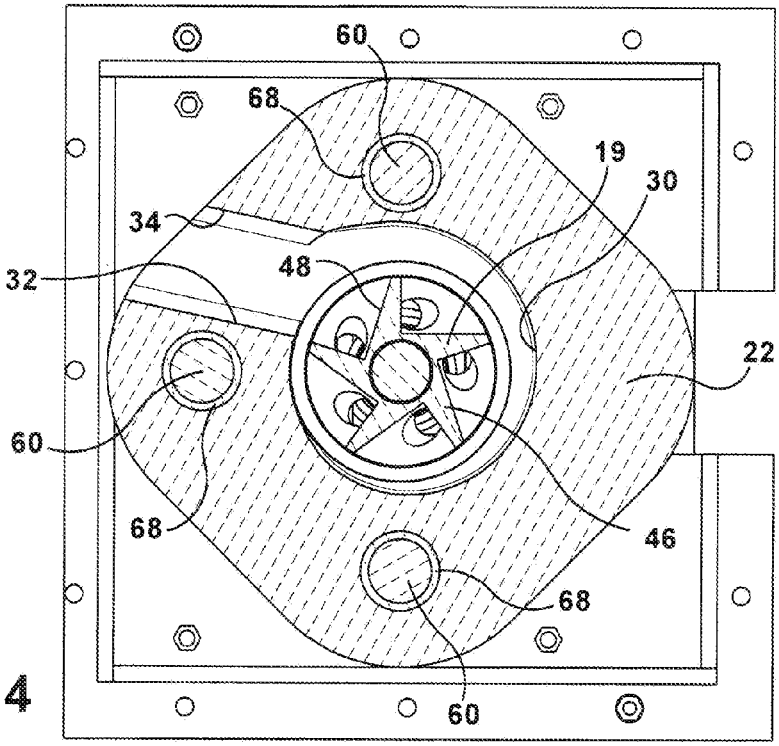
FIG. 4 is a cross-sectional view as seen along the cutting plane designated 4-4 in FIG. 1.
Figure 5:
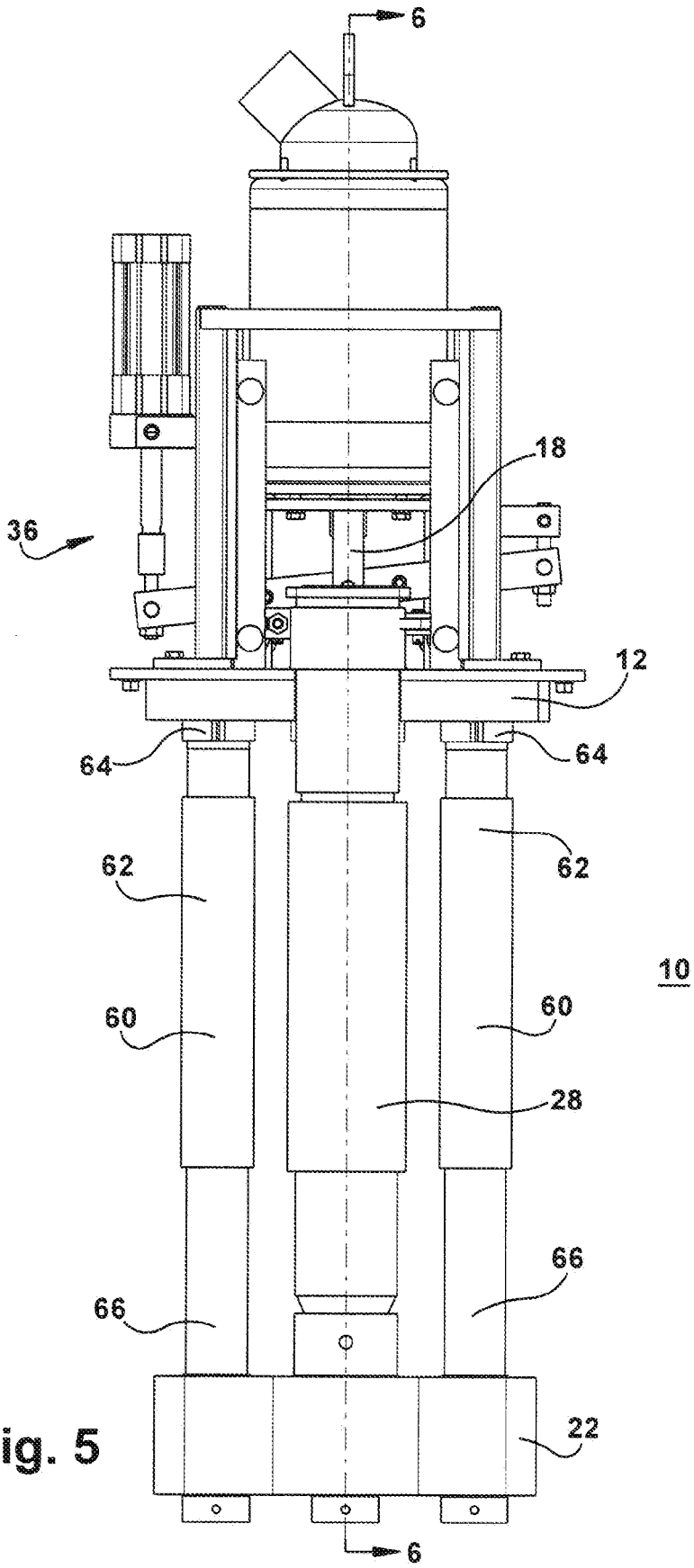
FIG. 5 is a side view of the cementless pump of FIG. 1 rotated 90 degrees.
Figure 6:
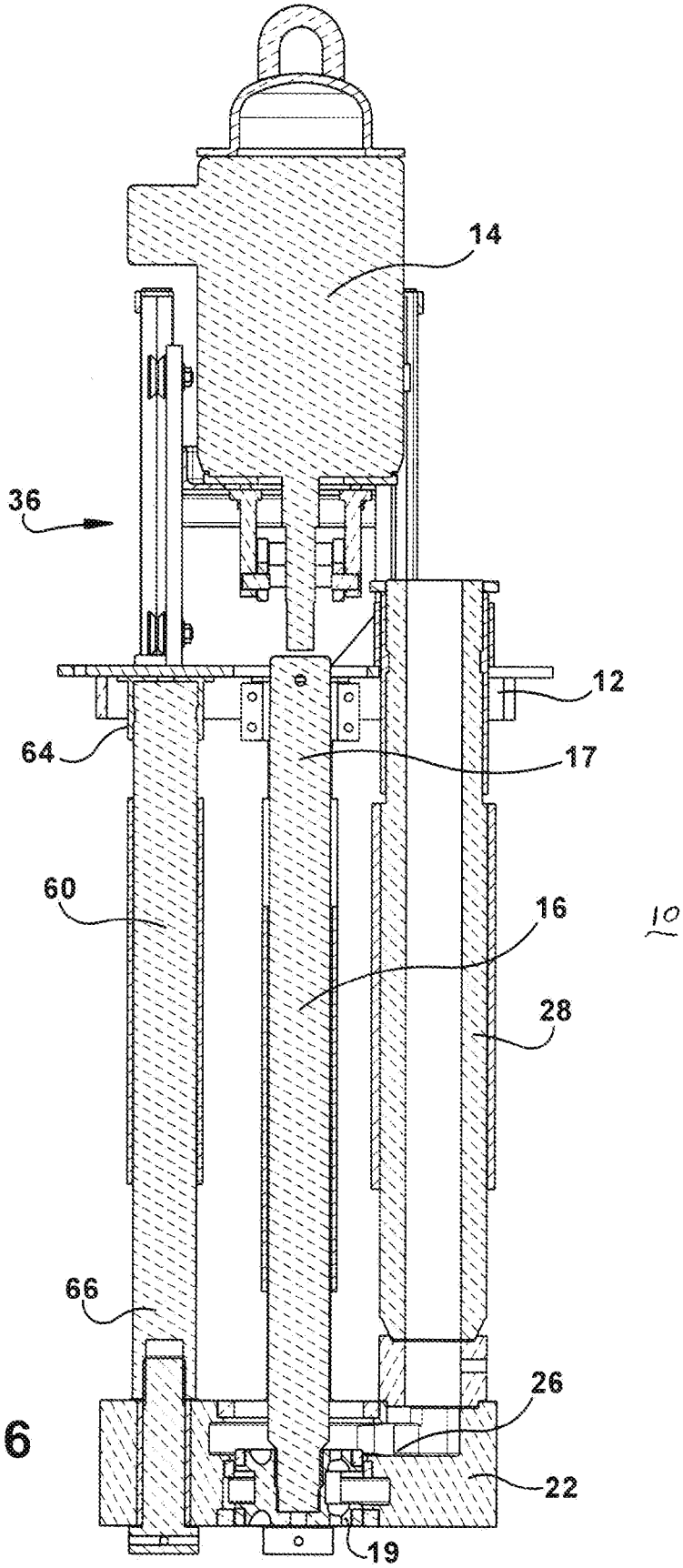
FIG. 6 is a vertical cross-sectional view as seen along the cutting plane designated 6-6 in FIG. 5.

Referring to FIG. 2B, in another aspect each of the post fastening members 70 can be a threaded nut 88 and a threaded elongated bolt portion 90 of the post 60 extending through the through hole of the base, which is threaded to the nut. The nut would ordinarily be located near the lower surface of the base. The nut can be countersunk into the base.

A refractory fiber gasket 92 can be disposed between a lower surface of each of the posts and the base and between each of the post fastening members and the base (e.g., between the lower surface of the base and the nut or bolt head). The fiber gasket can be a Fiberfrax® gasket by Carborundum. The post, including any elongated portion, the bolts and the nut are ideally made of refractory material such as graphite or ceramic. The base can be made of suitable refractory material such as graphite.

The refractory sleeve is softer than graphite. For example the refractory sleeve is made of ceramic, such as an aluminum boron oxide. A density of the refractory sleeve can be not greater than 0.60 g/cm$^3$, more particularly, not greater than 0.50 g/cm$^3$, and specifically about 0.48 g/cm$^3$.

In a method of replacing the posts of a molten metal pump, after the pump has been operated for awhile and the posts, shaft and/or rotor have become worn or damaged, it is desired to replace the posts, among other components of the pump. When the pump 10 has been operated for an extended period of time, wherein the base 22 and posts 60 have been submerged in the molten metal bath, molten metal may enter the through holes 58 of the base. This can be resisted by the use of the gaskets 92 between the posts and the upper surface 84 of the base and between the post fastening members 70 and the lower surface 86 of the base but may not be altogether prevented. As a result, once the pump has been removed from the molten metal and cooled, the metal can form a crust inside the through holes. When using the relatively soft refractory sleeves 68 of this disclosure in the through holes, the sleeves are easily removed without significant damage to the shape of the through holes 58. All that might remain is a thin crust of metal on the surface of the through holes after the refractory sleeves have been removed, which can easily be scraped out.

The method of replacing the posts of a molten metal pump includes the following steps. After the pump has been operated and it is desired to replace the posts 60, the pump 10 is removed from the molten metal and cooled. The posts 60 are removed from the clamps 64 on the bottom surface of the motor mount. The riser 28 is also unclamped. The posts 60 are cut near the upper surface of the base (e.g., through the bolts or through the elongated portion of the posts as shown by the dotted line of FIG. 2A). For example, the cutting may occur through the threads of the exterior threaded portion 82 of the bolt and any remaining piece of the post may be chiseled off the top of the bolt. The remainder of the bolt is removed from the through hole, such as by tapping a rigid rod into the through hole having a diameter somewhat less than the diameter of the through hole. The remaining refractory sleeve and any remaining metal adhered to the surface of the base that forms the hole can then be removed such as by scraping (e.g., without any need of machining)

Replacement posts 60 can be installed in the pump, along with the post fastening members, to form the cementless pump as described above. The base 22 includes the through holes 58 extending between the upper and lower surfaces of the base. The refractory sleeves 68 are inserted in each of the through holes so that there is a snug fit. The post fastening members 70 extend inside the refractory sleeves and can be in contact with the refractory sleeves. In the case of using an elongated portion 90 of the posts, the posts are positioned so that the elongated portions extend inside the refractory sleeves 68 out the bottom of the base 22. A refractory nut 88 is threaded to the threaded end portion of the refractory sleeve. In the other aspect of the post fastening members 70, the posts 60 are positioned over the through hole 58 containing the refractory sleeve. Each of the bolts 76 is positioned inside the opening 94 of the refractory sleeves and are threaded to the interior threaded opening 74 in the post 60. The bolts are tightened until the heads 78 contact the lower surface 86 of the base. The refractory gaskets 92 can be positioned between the posts 60 and the upper surface 84 of the base and between the lower surface 86 of the base and the nut 88 or bolt head 78, to minimize intrusion of molten metal into the through holes.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A cementless pump for pumping molten metal comprising:

support structure suspended above molten metal;

a motor supported by said support structure;

a shaft fastened at an upper end thereof to said motor and having a lower end;

an impeller mounted to said lower end of said shaft;

a refractory base supported in the molten metal, said base including at least one impeller chamber in which said impeller is rotated and at least one discharge passageway leading from said impeller chamber, said base including through holes each extending for a length and having a size transverse to the length;

support posts each fastened at an upper end thereof to said support structure and at a lower end thereof to said base, wherein each of said support posts includes a lower surface at the lower end that is larger than the size of the through hole;

refractory sleeves each disposed in one of said through holes, and post fastening members for fastening the lower ends of said posts to said base without cement, wherein a portion of each of said post fastening members is located inside said refractory sleeve, wherein each of said refractory sleeves is disposed between said lower surface of one of said support posts and a respective base engaging portion of a corresponding one of said post fastening members.

2. The cementless pump of claim 1 including a threaded opening at said lower end of each of said posts, and a bolt including a head as said base engaging portion, a shank extending from said head and a threaded portion at an end of said shank, wherein said shank is disposed inside said refractory sleeve and said threaded portion of said bolt is threaded to said threaded opening of said post so that said head engages said base, thereby fastening said posts to said base without use of any cement.

3. The cementless pump of claim 2 wherein said bolts are made of refractory material.

4. The cementless pump of claim 1 wherein each of said post fastening members includes a post elongated portion of one of said support posts disposed inside said refractory sleeve, said post elongated portion including a threaded end portion, and a refractory nut as said base engaging portion that contacts said base and is threaded to said threaded end portion.

5. The cementless pump of claim 1 comprising a refractory gasket disposed between the lower surface of each of said posts and said base and between each of said base engaging portions and said base.

6. The cementless pump of claim 1 wherein said refractory sleeves are softer than graphite.

7. The cementless pump of claim 1 wherein each of said refractory sleeves are configured and arranged to have an outer diameter and length that are the same as a diameter as said size of the through hole and said length of said through hole, respectively.

8. The cementless pump of claim 1 wherein said refractory sleeves are made of ceramic.

9. The cementless pump of claim 8 wherein said refractory sleeves are made of aluminum boron oxide.

10. The cementless pump of claim 1 wherein a density of said refractory sleeves is not greater than 0.60 g/cm$^3$.

11. The cementless pump of claim 1 comprising clamps that fasten the upper end of each of said support posts to said support structure.

12. The cementless pump of claim 1 wherein said support posts include refractory material throughout a cross-section thereof.

13. The cementless pump of claim 1 wherein said post fastening members are made of refractory material.

14. The cementless pump of claim 1 wherein said base is formed of machined graphite, said support posts comprise graphite throughout a cross-section thereof, said post fastening members are formed of graphite, a density of said refractory sleeves is not greater than 0.60 g/cm$^3$ and said refractory sleeves are softer than said machined graphite of the base.

15. A method of replacing posts of a cementless pump for pumping molten metal comprising the following steps:

providing support structure suspended above molten metal;

providing a motor supported by said support structure;

providing a shaft fastened at an upper end thereof to said motor and having a lower end;

providing an impeller mounted to the lower end of said shaft;

providing a refractory base supported in the molten metal, said base including at least one impeller chamber in which said impeller is rotated and at least one discharge passageway leading from said impeller chamber, said base including through holes each extending for a length and having a size transverse to the length;

providing support posts each fastened at an upper end thereof to said support structure and at a lower end thereof to said base, wherein each of said support posts includes a lower surface at the lower end that is larger than the size of the through hole;

providing refractory sleeves each disposed in one of said through holes;

providing post fastening members for fastening the lower ends of said posts to said base without cement, wherein a portion of each of said post fastening members is located inside said refractory sleeve;

wherein each of said refractory sleeves is disposed between said lower surface of one of said support posts and a respective base engaging portion of a corresponding one of said post fastening members, operating said pump until it is desired to replace said posts;

removing said pump from the molten metal;

cutting said posts near said base;

removing a remaining portion of said post fastening members from said base;

removing said refractory sleeve;

scraping any deposited molten metal from said through holes; and mounting replacement said posts to said base using replacement said post fastening members without using cement.

16. The method of claim 15 including a threaded opening at said lower end of each of said posts, and a bolt including a head as said base engaging portion, a shank extending from said head and a threaded portion at an end of said shank, comprising positioning said shank inside said refractory sleeve and connecting said threaded portion of said bolt to said threaded opening of said post so that said head engages said base, thereby fastening said posts to said base without use of any cement.

17. The method of claim 16 wherein said bolts are made of refractory material.

18. The method of claim 15 wherein each of said post fastening members includes a post elongated portion of one of said support posts disposed inside said refractory sleeve, said post elongated portion including a threaded end portion, and a threaded refractory nut as said base engaging portion, comprising connecting said nut to said threaded end portion against said base.

19. The method of claim 15 comprising providing a refractory gasket disposed between the lower surface of each of said posts and said base and between each of said base engaging portions and said base.

20. The method of claim 15 wherein said refractory sleeves are softer than graphite.

21. The method of claim 15 wherein each of said refractory sleeves are configured and arranged to have an outer diameter and length that are the same as a diameter as said size of the through hole and said length of said through hole, respectively.

22. The method of claim 15 wherein said refractory sleeves are made of ceramic.

23. The method of claim 22 wherein said refractory sleeves are made of aluminum boron oxide.

24. The method of claim 15 wherein a density of said refractory sleeves is not greater than 0.60 g/cm$^3$.

25. The method of claim 15 comprising providing clamps and a step of fastening the upper end of each of said support posts to said support structure using said clamps.

26. The method of claim 15 wherein said support posts include refractory material throughout a cross-section thereof.

27. The method of claim 15 wherein said post fastening members are made of refractory material.

28. The method of claim 15 wherein said base is formed of machined graphite, said support posts comprise graphite throughout a cross-section thereof, said post fastening members are formed of graphite, a density of said refractory sleeves is not greater than 0.60 g/cm$^3$ and said refractory sleeves are softer than said machined graphite of the base.

* * * * *